United States Patent [19]

Anger

[11] Patent Number: 4,685,224

[45] Date of Patent: Aug. 11, 1987

[54] INSOLE

[76] Inventor: Wolfgang Anger, Hellwiesen 5, D-3002 Wedemark 9, Fed. Rep. of Germany

[21] Appl. No.: 754,646

[22] Filed: Jul. 12, 1985

[51] Int. Cl.[4] ..... A43B 17/03; A43B 07/06

[52] U.S. Cl. ..... 36/43; 36/44; 36/3 B; D2/318

[58] Field of Search ..... 36/43, 44, 3 R, 3 B, 36/28, 29, 59 R, 59 C, 116, 25 R, 32 A; D2/318, 320

[56] References Cited

U.S. PATENT DOCUMENTS

| | | | |
|---|---|---|---|
| D. 70,701 | 7/1926 | Precourt | D2/320 |
| 1,194,152 | 8/1916 | Douglas | 36/3 B |
| 1,517,610 | 12/1924 | Bayless | 36/43 |
| 1,605,588 | 11/1926 | Huiskamp | 36/25 R |
| 2,334,719 | 11/1943 | Margolin | 36/3 B |
| 2,856,771 | 10/1958 | Anderson | 36/44 |
| 3,274,708 | 9/1966 | Lukas | 36/3 R |
| 3,426,455 | 2/1969 | Drago | 36/44 |
| 4,075,772 | 2/1978 | Sicurella | 36/43 |
| 4,281,467 | 8/1981 | Anderie | 36/32 R |

FOREIGN PATENT DOCUMENTS

| | | | |
|---|---|---|---|
| 203734 | 4/1908 | Fed. Rep. of Germany | 36/44 |
| 2847417 | 5/1980 | Fed. Rep. of Germany | 36/43 |
| 3344764 | 6/1985 | Fed. Rep. of Germany . | |
| 1314418 | 12/1962 | France | 36/44 |
| 1511344 | 1/1968 | France | 36/43 |
| 364834 | 11/1938 | Italy | 36/3 B |
| 306358 | 8/1951 | Switzerland | 36/43 |
| 400830 | 4/1966 | Switzerland | 36/3 B |
| 499279 | 1/1971 | Switzerland | 36/3 B |

*Primary Examiner*—Werner H. Schroeder
*Assistant Examiner*—Steven N. Meyers
*Attorney, Agent, or Firm*—Lockwood, Alex, FitzGibbon & Cummings

[57] ABSTRACT

A foam latex insole includes a number of ribs on its undersurface. The ribs face the top-sole of a shoe when the insole is placed therein, and are formed of foam latex which is closed-pored and somewhat firmer than the foam latex which forms the continuous part of the insole. The ribs can be straight, curved or sharply bent, and form a labyrinth of ventilation channels between the top-sole of the shoe and the underside of the foot. The arrangement of the rib is such that a pumping effect is developed in response to pressure changes on the insole which promotes the exchange of air within the shoe to maintain a suitable environment for the feet.

16 Claims, 4 Drawing Figures

INSOLE

BACKGROUND OF THE INVENTION

The present invention relates generally to insoles for shoes and particularly to an insole having a plurality of ribs formed along the undersurface thereof.

In most temperate climates, it is not unusual, particularly in the colder seasons, for a significant portion of the population to suffer either continuously or intermittently from cold feet. This occurs not only as a result of cold outside air temperature, but also as a result of increased skin temperature and sweating which follows physical exertion such as walking or running. When sweating occurs, sweat is absorbed by the clothing around the feet. If sufficient air circulation is provided, excess moisture will soon be diverted from the feet. However, if the foot clothing permits insufficient circulation, water vapor will condense at normal room temperatures and the feet will remain damp. Such dampness can be felt for hours, particularly when the feet do not perform any work during sitting and foot skin temperature drops as a result of slight, constant evaporation of excess moisture.

The importance of the micro-climate in the clothed foot to the general health and well-being of the population is the subject of increasing awareness. On the basis of scientific investigation into the bioclimate of the clothed foot conducted by the Work Group at the Institute for Work Physiology of the Institute of Technology Munich between the years 1967 and 1975, it has been determined that human feet stay comfortable when foot skin temperature is maintained between 30° C. and 35° C. at a relative humidity of no more than 65%. Higher relative humidities result in a damp, uncomfortable feeling. Thus, comfort is greatly affected by both the temperature and humidity within the shoe which, in turn, are each subject to a variety of endogenous as well as exogenous influences. Since, in temperate climates, the quantity of sweat produced by each foot can be as great as 70 ml every 12 hours, the physical properties of the foot clothing have a pronounced effect on the micro-climate within the shoe.

Prolonged undercooling of the feet is harmful to health. A long lasting, warm and moist climate at the foot promotes mycosis, eczemas and, on occasion, allergies as well. It is estimated that the majority of adults suffer from dermatosis of the foot as well as various other diseases of the skin. Large indoor swimming pools, saunas, and dressing rooms of swimming and sports facilities provide ample opportunity for such infection to spread. This problem is compounded as various sport and leisure time activities become increasingly popular.

In view of the various foot disorders likely to result from an excessively hot and humid micro-climate within the shoe, it is an important function of foot clothing to help reduce the dampness of the feet. Generally, effective reduction of such dampness requires effective air circulation between the foot and the surrounding foot clothing. However, depending on the particular type of foot clothing, such circulation might only exist to a limited degree.

The present invention is directed to an insole which not only absorbs the sweat of the foot, but which also permits, and promotes, air movement within the shoe to enhance air circulation around the foot. The insole not only permits the movement of air, but also functions to provide a pumping effect which brings about additional air circulation. Since the ability of an insole to directly absorb sweat is limited by the volume of the insole and by the surface area of the cell structure of which it is formed, the additional air circulation provided by the insole of the present invention greatly enhances its ability to carry sweat from the feet and thereby reduce humidity within the shoe.

The insole of the present invention is adapted to maintain a comfortable micro-climate within the shoe both when the foot is at rest and when the foot is moving during walking. Since little heat is generated when the foot is at rest, the insole preferably functions to thermally insulate the feet from cold outside air temperatures. Accordingly, the insole is constructed to minimize the conduction of heat from the sole of the foot to the top-sole of the shoe.

To provide such thermal insulation, the insole can be satisfactorily formed from a fine-pored foam latex. Since still air is a highly effective heat insulator, it is preferable that the foam have cell walls which are as thin as possible. Expressed differently, the specific weight of the foam used in the insole is preferably as low as possible. It will be appreciated however that, in addition to foam latex, other materials, such as closed-pored foams formed of polyvinyl chloride or polyurethane, as well as various felts, non-woven fabrics, cardboard, leather and leather fiber plates, are also heat insulators and can be satisfactorily used.

During, and immediately following physical activity such as walking or running, the conditions within the shoe change markedly from when the foot is at rest. This occurs as a consequence of increased sweating and as a further consequence of increased skin temperature which results from increased blood circulation to the feet. The combination of sweat and increased temperature form water vapor. If not removed from the foot clothing as fast as possible, such water vapor forms a warm, moist micro-environment around the foot which can promote the growth of fungi and microbes. If the outside air temperature is cold, great discomfort may be experienced as a result of the increased dampness.

In view of the foregoing, it is desirable that insoles have sufficient capacity to fully absorb the first discharge of sweat from the feet. The permeability of the insole to water vapor is preferably as great as possible to permit the vapor to be effectively carried from the vicinity of the feet. Additionally, the insole preferably provides for a hollow space or ventilation channel to be formed beneath the sole of the foot in order to permit the free flow of water vapor therethrough such that excess dampness of the foot is avoided.

Permeability to air is a desired attribute of the insole since water vapor is preferably diverted away from the sole of the foot, through the shaft of the shoe, and then to the outside air. While it is preferable for the insole to act as an insulator when the foot is at rest, the increased heat and moisture produced upon physical exertion must not be insulated, but must be diverted by means of thermoconduction, radiation and convection. As heat radiation is generally insignificant, conduction is the primary mechanism by which heat is carried from the shoe. If the stocking and the sole of the shoe are damp, such heat conduction is more effective than when the foot clothing is dry.

Reduced permeability of foot clothing results in relatively greater humidity of the micro-climate within the shoe. Typically, the shoe sole, which consists of an out-sole, an insole, and a top-sole, is the least permeable structure of ordinary foot clothing. Accordingly, the greatest difficulty is encountered in keeping the sole of the foot dry when increased sweating of the foot occurs. Since it is becoming increasingly common to replace some or all of the natural fibers in stockings with synthetic fibers, such stockings are less and less capable of effectively insulating the foot when it is at rest, or of absorbing moisture during, and immediately following, physical activity. Accordingly, as stockings play a smaller and smaller role in maintaining an optimum bioclimatic environment within the shoe, the role played by the insole takes on an increasing importance.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several Figures of which like reference numerals identify like elements, and in which:

DESCRIPTION OF THE PREFERRED EMBODIMENT

Figure 1A:
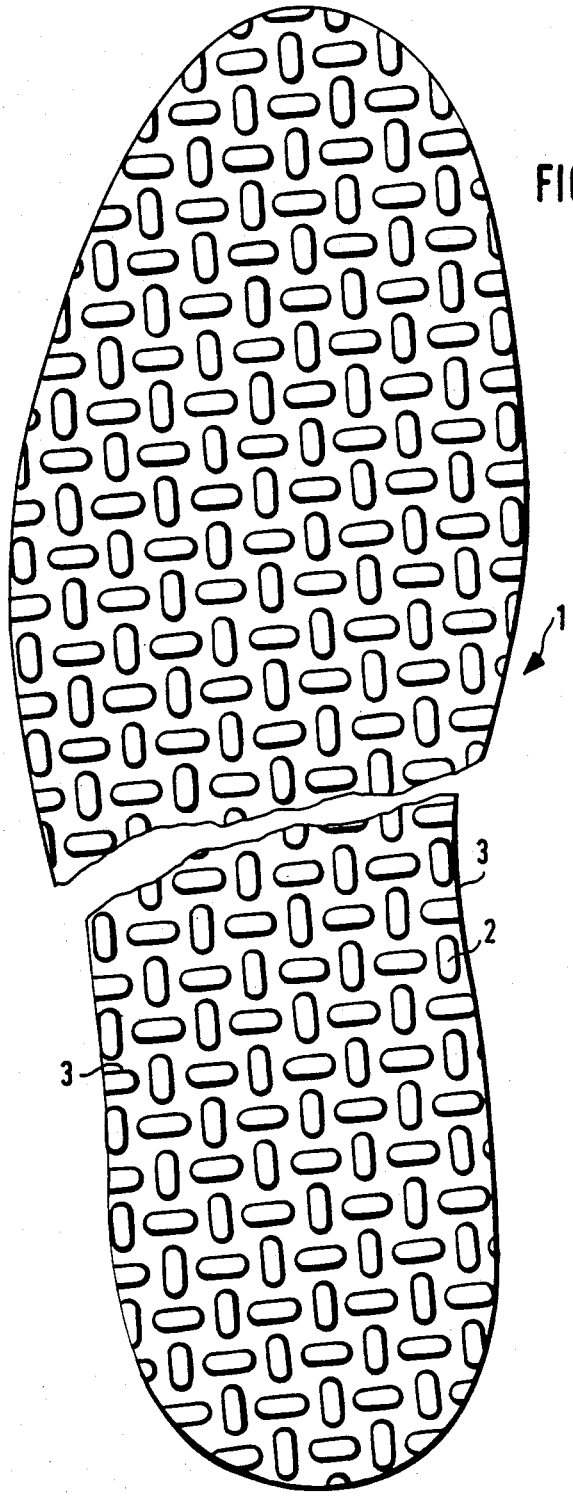
FIG. 1A is a bottom plan view of the underside of an insole constructed in accordance with the invention.
Figure 2:
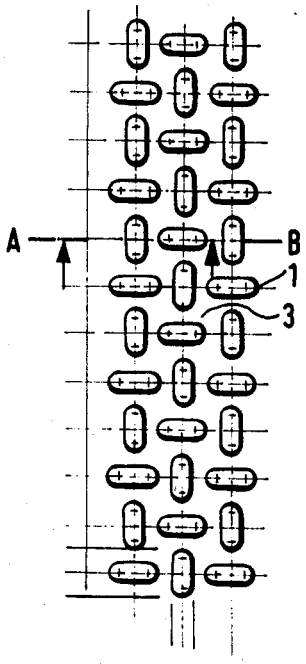
FIG. 2 is a fragmentary plan view of the underside of the insole illustrated in FIG. 1.
Figure 1B:
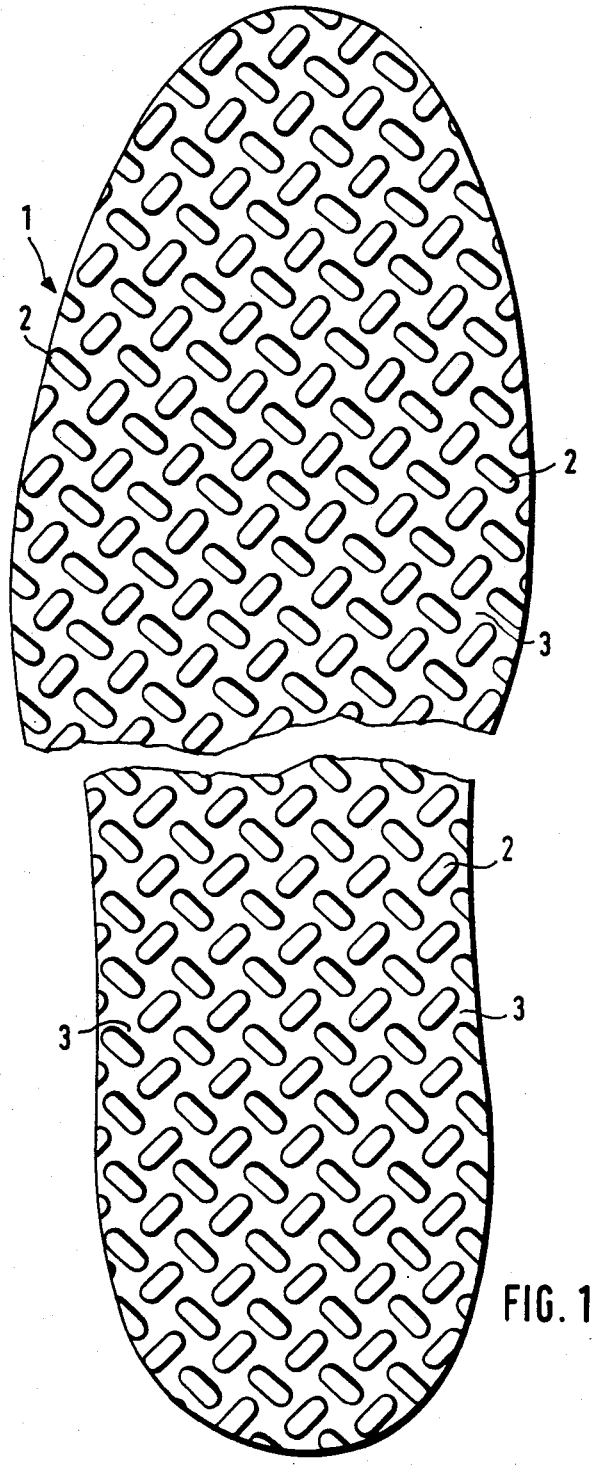
FIG. 1B is a bottom plan view of the underside of an alternate embodiment of an insole constructed in accordance with the invention.

Referring to the drawings, and in particular to FIGS. 1A and 1B, insoles 1, constructed in accordance with the invention, are illustrated.

On prior insoles formed of foam latex, the smooth underside of the foam latex lies so firmly on the top-sole of the shoe that, in spite of the open-cell foam, only vertical air movement occurs between the top-sole of the shoe and the sole of the foot in response to compression and relaxation of the insole during walking. Accordingly, in prior insoles, air movement in a horizontal plane is almost nonexistent.

While some prior insoles have been provided with structured undersides, such structuring has typically consisted of a grid pattern of multi-cornered raised crossbars which extended over the entire sole. Such crossbars, when pressed against the top-sole of the shoe, engaged the top-sole as firmly, and as completely, as insoles which did not include such surface structuring. Accordingly, despite the addition of such full length crossbars, air movement in a horizontal plane was nevertheless restricted.

Insole 1, as illustrated in FIGS. 1A and 1B, is not of uniform thickness over its entire height, but includes a plurality of raised ribs on the underside thereof which engage the top-sole of the shoe when the insole is placed therein. Ribs 2, like the remaining full-walled portion of the insole, are formed of foam latex but are closed-pored and have sufficient firmness such that they are not pressed completely flat during walking even when loaded under the full weight of the wearers body. Furthermore, the foam latex of which ribs 2 are formed is selected such that the ribs expand quickly to their normal full size when the load on the insole is lessened. In accordance with one aspect of the invention, ribs 2 are arranged on the undersurface of the insole such that a labyrinth-like formation of hollow spaces, or air conducting ventilation channels 3, is formed between the top-sole of the shoe and the underside of the continuous portion of the insole when the insole is positioned therein. The arrangement is also such that all of the hollow spaces 3 are continuous with one another such that horizontal air circulation can take place between the top-sole of the shoe and the continuous portion of the insole through the ventilation channels so formed.

As further illustrated, the ribs 2 are arranged such that they comprise approximately half (35% to 55%) the entire undersurface of the insole. As illustrated, the ribs are also arranged such that their longitudinal axes run at right angles to one another and such that adjacent ribs are perpendicular to one another as shown in FIG. 1A. It will be appreciated, however, that the ribs can also be arranged in a different manner such as, for example, in a herringbone pattern or in the form of a polygon such as a square or the like.

The length of the ribs can be between 4 mm and 15 mm with a width of between 2 mm and 4 mm and a height of between 1 mm and 2.5 mm. Preferably, the ribs are approximately 8 mm long and have a height of 1.7 mm to 2 mm. The entire thickness of the insole can range between 3.3 mm and 5.0 mm, however, the insole preferably has an overall thickness ranging between 3.5 mm and 4.0 mm including the ribs. Preferably the ribs height is equal to the thickness of the continuous portion of the insole.

In arranging the ribs, attention is paid not only to assuring that a labyrinth-like pattern of hollow spaces between the ribs is formed, but also to assuring that sufficient space exists between the ribs such that air circulation can take place through the hollow spaces adjacent the top-sole of the shoe. Preferably, the upper surface of the continuous portion of the insole, which actually contacts the underside of the foot, is covered with a textile layer.

In addition to the foregoing, attention is also paid to assuring that the spatial stability of the sole is preserved everywhere and especially in the direction of the foot. To provide adequate bending strength, the ribs are arranged such that no substantially straight channel extends fully across the insole along which bending of the insole would be encouraged. As long as these considerations are taken into account, the precise arrangement of the ribs can differ from the arrangements illustrated in FIGS. 1A and 1B. For example, the ribs can be of greater or lesser length than those shown, and can be straight, curved or sharply bent. The arrangements shown in FIGS. 1A and 1B are examples of arrangements which have been found to be satisfactory and advantageous.

Bending strength of the insole is of importance primarily when inserting the insole into the shoe. Such strength is also beneficial so that the motion of the foot will not shift the position of the insole within the shoe causing the insole to bunch together in the area of the toes.

Figure 3:
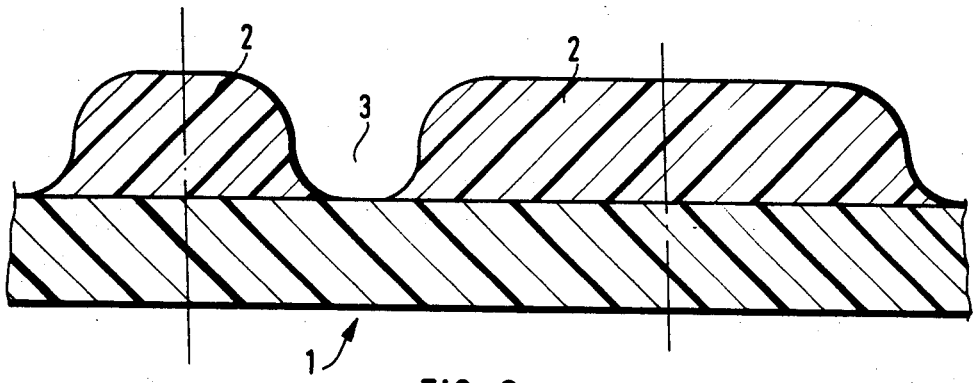
FIG. 3 is a cross-sectional view of the insole illustrated in FIG. 2 taken along line A–B thereof.

FIG. 3 illustrates the relative size and shape of the ribs 2 which are seen to be generally tapered as shown. Since the ribs comprise roughly half the undersurface of the insole but must nevertheless support the full weight of the wearer, the pressure resistance of each rib is preferably about twice that of the foam latex which forms the continuous portion of the insole. Accordingly, the ribs are formed from foam latex which has correspondingly higher specific weight than that forming the continuous portion of the insole and, in addition, is preferably of closed-pored construction. This assures that the ribs will tend to retain their shape even under the pressure of the foot during walking.

The structure of the insole, and in particular, the composition, shape, size and orientation of the ribs, results in the creation of a pumping effect when the insole is subjected to compression and release during normal walking. This pumping effect tends to force air through the labyrinth of hollow spaces 3 formed between the continuous portion of the insole and the top-sole of the shoe and assists in avoiding excessive humidity within the shoe. It will also be observed that the pattern of the ribs is such that no substantially straight ribless zone is formed over the entire undersurface of the insole which could make possible a sharp bending of the top layer.

While a particular embodiment of the invention has been shown and described, it will be obvious to those skilled in the art that changes and modifications may be made without departing from the invention and its broader aspects, and, therefore, the aim in the appended claims is to cover all such changes and modifications as fall within the true spirit and scope of the invention.

I claim:

1. An insole comprising a continuous portion of substantially uniform thickness having formed on the underside thereof a plurality of projecting ribs arranged so as to oppose bending of said continuous portion, said ribs being uniformly spaced from and at angles to one another and arranged so as to form a labyrinth-like, non-straight, continuous air conveying channel between said continuous portion and the top-sole of a shoe when said insole is positioned within the shoe, said channel being open at the edges of said continuous portion and said ribs pumping air through said channel and past the edges of said continuous portion.

2. An insole is defined in claim 1 wherein said ribs cover between 35% and 55% of said undersurface of said continuous portion and said air channel are formed between said ribs.

3. An insole as defined in claim 2 wherein the height of each of said ribs is substantially equal to the thickness of said continuous portion.

4. An insole as defined in claim 3 wherein said ribs are uniformly spaced from one another and are arranged such that said channel is non-straight and that bending of said continuous portion along said channel is opposed.

5. An insole as defined in claim 4 wherein said ribs are arranged in a herringbone pattern.

6. An insole as defined in claim 4 wherein said angles are substantially right angles.

7. An insole as defined in claim 6, wherein said ribs are closed-pored whereby said channel is present when said insole is loaded under the full weight of the wearer.

8. An insole as defined in claim 1 wherein the height of each of said ribs is substantially equal to the thickness of said continuous portion.

9. An insole as defined in claim 8 wherein said ribs are uniformly spaced from one another and are arranged such that said channel is non-straight and that bending of said continuous portion along said channel is opposed.

10. An insole as defined in claim 9 wherein said ribs are arranged in a herringbone pattern.

11. An insole as defined in claim 9 wherein said angles are substantially right angles.

12. An insole as defined in claim 1 wherein said ribs are arranged in a herringbone pattern.

13. An insole as defined in claim 1 wherein said angles are substantially right angles.

14. An insole as defined in claim 1, wherein said ribs are closed-pored whereby said channel is present when said insole is loaded under the full weight of the wearer.

15. An insole as defined in claim 1, wherein said ribs are closed-pored whereby said channel is present when said insole is loaded under the full weight of the wearer.

16. An insole comprising a continuous portion of substantially uniform thickness having formed on the underside thereof a plurality of projecting ribs arranged at substantially right angles to one another and so as to form a labyrinth-like continuous air conveying channel between said continuous portion and the top-sole of a shoe when said insole is positioned within the shoe, said channel being open at the edges of said continuous portion and said ribs pumping air through said channel and past the edges of said continuous portion.

* * * * *